US006523535B2

(12) United States Patent
Rehkemper et al.

(10) Patent No.: US 6,523,535 B2
(45) Date of Patent: Feb. 25, 2003

(54) TOY PROJECTILE LAUNCHER

(75) Inventors: Steven Rehkemper, Chicago, IL (US); Jeffrey Rehkemper, Chicago, IL (US); Todd Hannon, Burlington, WI (US); Ryan Kratz, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 09/813,675

(22) Filed: Mar. 21, 2001

(65) Prior Publication Data

US 2002/0134366 A1 Sep. 26, 2002

(51) Int. Cl.[7] ..... F41B 4/00
(52) U.S. Cl. ..... 124/78
(58) Field of Search ..... 124/6, 78

(56) References Cited

U.S. PATENT DOCUMENTS 4,325,351 A * 4/1982 Yuasa ..... 124/78
5,471,967 A 12/1995 Matsuzaki et al.
5,611,321 A 3/1997 Hoeling et al.
5,711,285 A 1/1998 Stewart et al.
5,782,228 A * 7/1998 Wu ..... 124/6
5,791,326 A 8/1998 Brown et al.
5,988,152 A 11/1999 Halter et al.
5,996,564 A * 12/1999 Kotowski ..... 124/6
6,116,229 A * 9/2000 Wu ..... 124/6
6,119,671 A 9/2000 Smith et al.

* cited by examiner

*Primary Examiner*—John A. Ricci

(57) ABSTRACT

This invention is a toy projectile launcher that launches projectiles. The launcher includes a housing having an entrance and an exit in communication therewith to define a channel, a pair of flywheels supported by the housing and positioned about and in communication with the channel, and a pump handle for rotating the flywheels such that a projectile entering the channel may be engaged by the rotating flywheels and impelled through the channel and out through the exit.

17 Claims, 10 Drawing Sheets

TOY PROJECTILE LAUNCHER

FIELD OF THE INVENTION

This invention relates generally to toy projectile launchers, and more particularly to a dual flywheel powered toy projectile launcher.

BACKGROUND OF THE INVENTION

Toy projectile launchers are well known in the art. These toys are suitably made for children and use harmless foam projectiles that are launched through the air. These launches may employ various spring loaded mechanism, such as disclosed in U.S. Pat. No. 5,711,285, which includes a pair of spring loaded launch tubes to separately launch projectiles. Other mechanisms such as disclosed in U.S. Pat. No. 5,791,326 employs compressed air. In addition thereto, flywheels or launching wheels have further been incorporated in these toys, such as the launching wheels disclosed in U.S. Pat. No. 5,471,967 or those employed in any self-pitching machine device.

In addition thereto, launching toys have developed various means for loading and firing multiple projectiles. For example: U.S. Pat. No. 5,988,152 discloses a toy gun that fires multiple projectiles with a single cycle of an actuation device, which is arranged to engage a spring that moves a reciprocating piston that fires the projectiles; and U.S. Pat. No. 5,711,285 mentioned above includes two launch tubes that separately launch projectiles.

Furthermore, the energy or power supplied by these toys to launch the projectiles is limited by the launching mechanisms. Launchers that utilize spring loaded mechanisms, pressurized air mechanisms and even some battery operated launching wheel mechanisms include a predetermined supply of energy. For instance, in a spring loaded mechanism the total amount of energy capable of being supplied to launch the projectile is determined from the spring, or in a battery operated launcher the total amount of energy is determined from the total output from the battery. A need therefore exists to provide projectile launchers that permit the user to control the amount of energy being supplied to launch the projectile. The user may then achieve a higher performance, meaning the user may launch the projectiles further then in a launcher that supplies a limited amount of energy.

In one such attempt, U.S. Pat. No. 5,611,321 discloses a ball launching device utilizing a self-propelled launching wheel to launch balls. As opposed to the above methods of supplying energy to the launching wheel, the '321 patent uses a hand pump to spin the launching wheel. As such, the users ability to repeat the spinning of the launching wheel at a faster rate will increase the launching velocity of the balls. As such a person with greater strength is capable of obtaining a higher or increase performance. However, the need still exists for improvements thereon. For instance, while the launching wheel may build up energy from repeated pumping, the energy drains quickly, since there is no means for storing this energy. Also, the incorporation of a single launching wheel will expel its energy quicker, then multiple wheels.

SUMMARY OF THE INVENTION

In accordance with the present invention, there is provided a toy projectile launcher having a housing that supports a handle, a launch channel, and a pump handle. The launch channel has an entrance and an exit, which permits a projectile to enter and exit therethrough. The projectile launcher includes a pair of flywheels that are in communication with and separately positioned on either side of the launch channel. The pump handle is slidably connected to the housing and is in communication with the pair of flywheels such that when the pump handle is moved inwardly the flywheels rotate. In addition, the projectile launcher includes a means for preventing a projectile positioned in the entrance opening from entering the launch channel and thus being launched, as well as including a triggering means for releasing the preventing means. As such, when a projectile is loaded in the entrance opening, a user gripping the handle must press the triggering means to move the projectile from the entrance opening to the launch channel. If the user has sufficiently rotated the flywheels, then the flywheels will engage the projectile entering the launch channel and impel it out of the exit opening.

Various shapes of projectiles are plausible, for instance the present invention includes a dart, glider and sphere. Because these darts have different shapes, the launch channel has an internal shape similar thereto, to permit the projectile to travel therethrough substantially unobstructed. In addition, the contour of the flywheels is substantially the same as the tip of the projectile, in order to adequately grip the tip of the projectile and launch it through the channel.

When the body of the projectile is larger than the tip, as in the glider, the flywheels further include grooves that permit the body of the projectile to travel therethrough substantially friction free. In yet other embodiment of the present invention, when the projectile launcher includes spheres, the launch channel may be pivotably attached to the housing, which permits the launched spheres to have a curved trajectory.

Numerous other advantages and features of the invention will become readily apparent from the following detailed description of the invention and the embodiments thereof, from the claims, and from the accompanying drawings.

BRIEF DESCRIPTION OF THE FIGURES

A fuller understanding of the foregoing may be had by reference to the accompanying drawings, wherein.

DETAILED DESCRIPTION OF THE INVENTION

Figure 1:
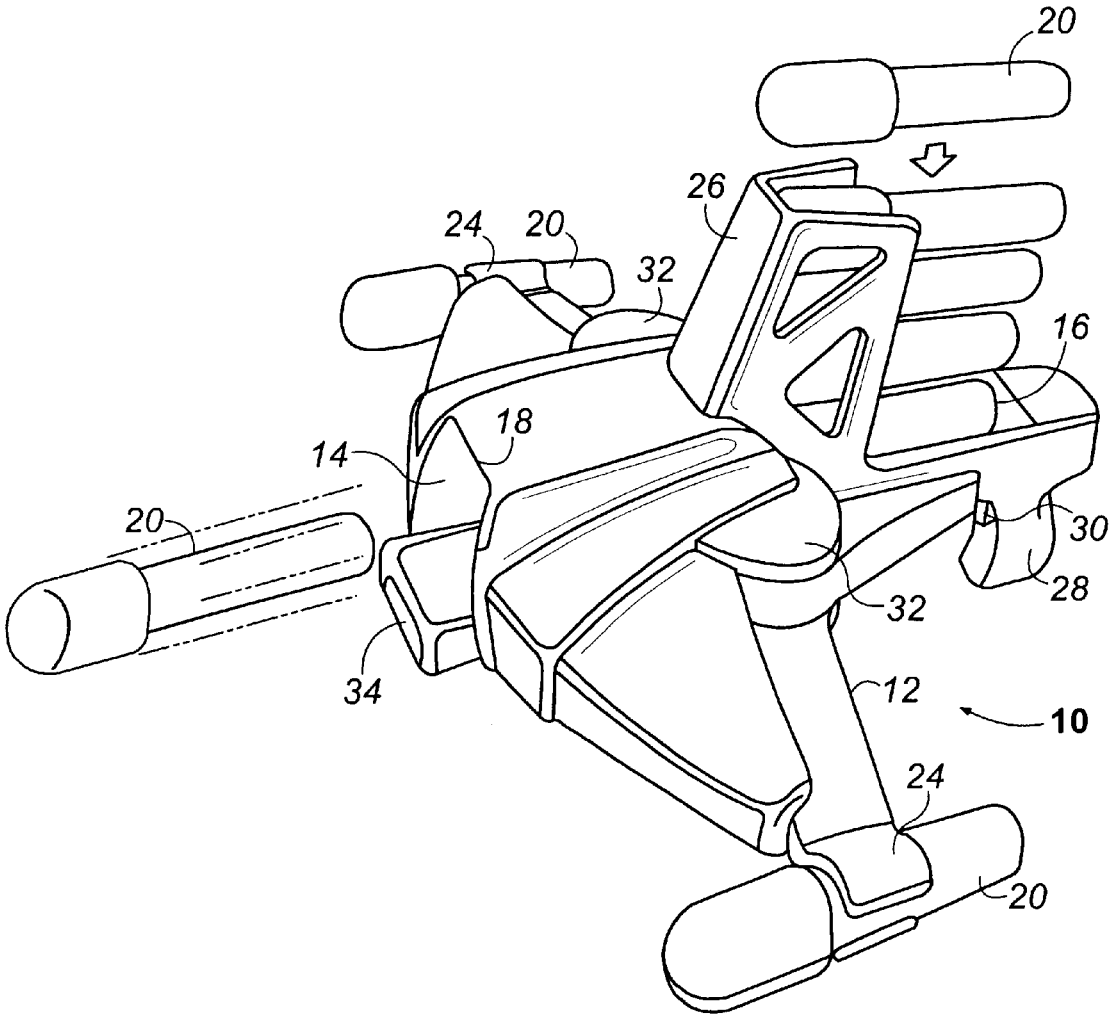
FIG. 1 is a perspective view of one embodiment of the present invention showing a projectile launcher that launches darts.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring first to FIG. 1, a projectile launcher in accordance with one embodiment of the present invention is shown and generally referenced to as 10. The projectile launcher 10 includes a housing 12 that supports a launch channel 14 having a entrance opening 16 and an exit opening 18, through which foam darts 20 may be loaded and projected therethrough. The housing 12 may also support clips 24 for storing or holding extra darts 20. Multiple darts may be loaded or stacked in a chute 26 that is in communication with the entrance opening 16, providing a means for rapid or repeated firing of subsequent darts 20. A handle 28 at one end of the projectile launcher 10 permits a user to hold and angle the projectile launcher 10 in a desired direction. As described in greater detail below, the projectile launcher 10 includes a pair of flywheels (not shown) housed in apertures 32, which are separately positioned on either side of and in communication with the launch channel 14. If a dart 20 is released into the launch channel 14 while the flywheels are rotating, the dart 20 is projected or launched through the exit 18.

Figure 2:
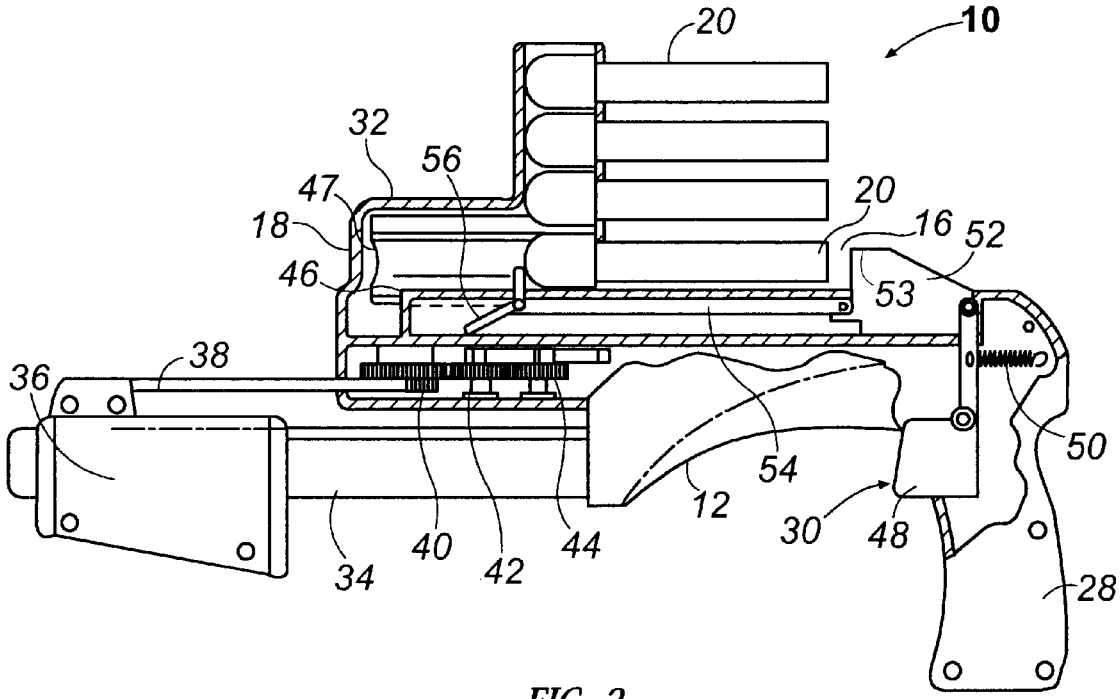
FIG. 2 is a partial cross-sectional view of the projectile launcher from FIG. 1.

Referring now to FIG. 2, the projectile launcher 10 has a shaft 34 that accommodates a slidable pump handle 36 which is in communication with the flywheels 46, such that by sliding the pump handle 36 inwardly (towards the other handle 28) the flywheels 46 will rotate and energize. In greater detail, the pump handle 36 has a rack 38 that is in engagement with a slider gear 40. When the pump handle 36 is moved inwardly, the rack 38 will move the slider gear 40 such that it engages a transfer gear 42. Continued movement of the pump handle 36 inwardly causes the slider gear 40 to rotate the transfer gear 42, which will rotate a combo gear 44 that is in communication with the pair of flywheels 46 separately located in the apertures 32. As such, the rotation of the transfer gear 42 rotates and energizes the flywheels 46. When the pump handle 36 is moved away from the handle 26 (defined as moving outwardly), the rack 38 moves the slider gear 40 into an idle position, such that the slider gear 40 is no longer in engagement with the transfer gear 42. Moving the pump handle 36 inwardly and outwardly repeatedly keeps the flywheels 46 rotating such that the energy being stored is greater to or equal to the energy being expelled, thus maximizing the energy which will be transferred to the dart 20, when the dart is moved from the entrance opening 16 to the launch channel 14.

The projectile launcher 10 further has the means to prevent a dart 20 from entering the launch channel 14; this will prevent the dart 20 from launching until the user has sufficiently energized the flywheels 46. When the flywheels 46 are sufficiently energized or rotating, the user may release the preventing means by pressing a trigger means 30 located on the handle 28. By pressing the trigger means 30, the user will release the preventing means and cause a dart 20 positioned in the entrance opening 16 to move into the launch channel 14, which will then be engaged by the rotating flywheels 46 and launched out of the exit opening 18.

The trigger means 30 includes a trigger 48 that is pivotally attached to the housing 12 and is outwardly biased by a return spring 50. A hammer 52 also attached to the trigger 48 will move outwardly when the trigger 48 is pressed inwardly. Upon releasing the trigger 48, the return spring 50 will bias the trigger 48 outwardly, returning the hammer 52 to its initial position. The hammer 52 is attached to a retaining arm 54 that initially prevents the dart 20 from entering the launch channel 14. However, when the hammer 52 moves outwardly, it pushes the retaining arm 54. The retaining arm 54 being positioned in a guide slot 56 will be guided downwardly away from the dart 20 when pushed by the hammer 52. As such, the dart 20 will be free to enter the launch channel 14.

Figure 3A:
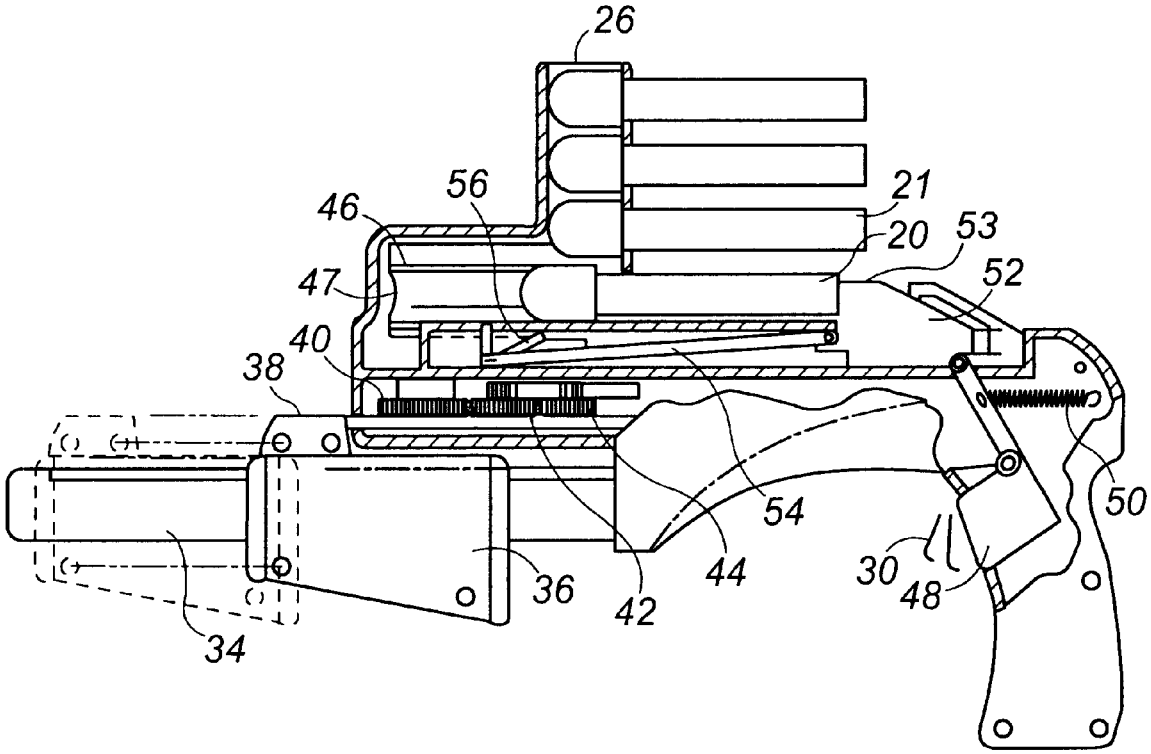
FIG. 3*a* is a partial cross-sectional view of the projectile launcher from FIG. 1, illustrating the various components of the triggering means.
Figure 3B:
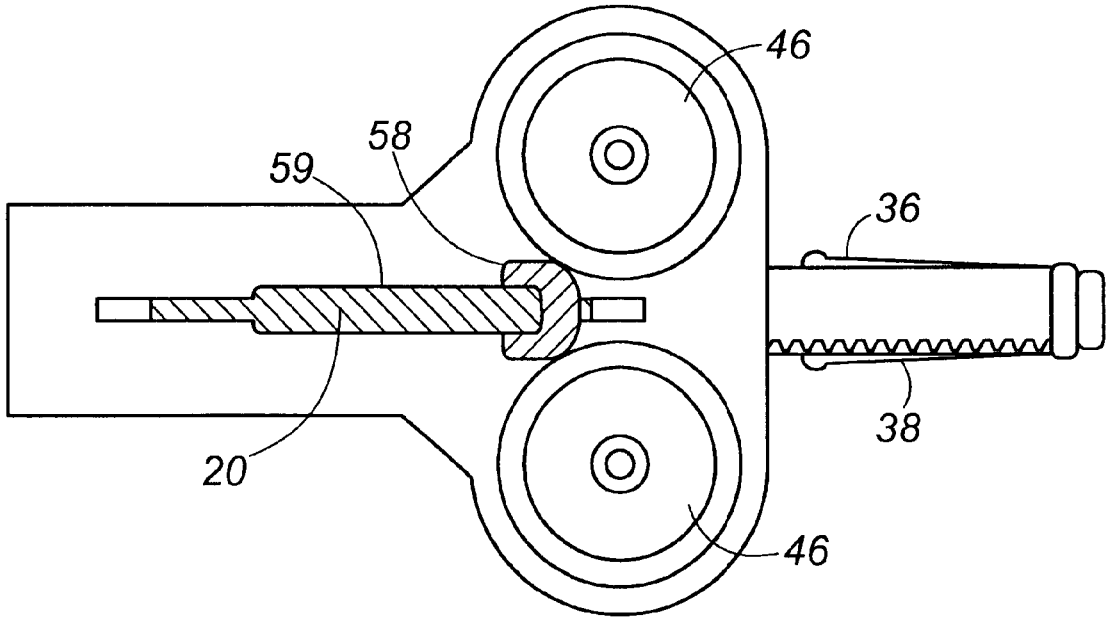
FIG. 3*b* is a cross-sectional top view of the projectile launcher from FIG. 1 showing a dart prior to being engaged by the flywheels.
Figure 3C:
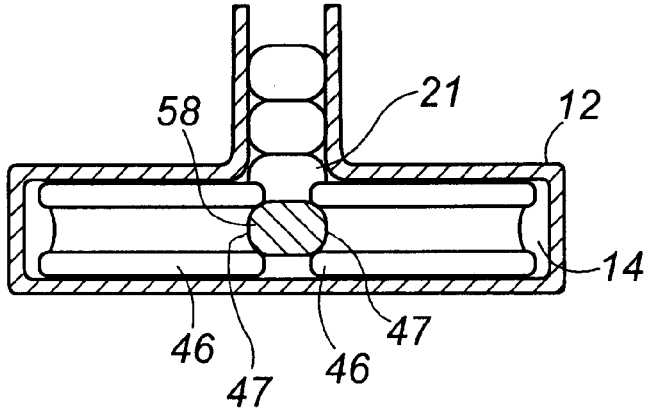
FIG. 3*c* is a front view of the projectile launcher from FIG. 1 showing the contour of the flywheels and the tip of the dart.

Referring now to FIGS. 3*a* through 3*c*, it is shown that when the trigger means 30 is pressed, the hammer 52 pushes the retaining arm 54 within the guide slot 56 away from the dart 20. As such, a dart 20 may move from the entrance opening 16 to the launch channel 14. In order to make sure the flywheels 46 engage the first dart 20, the hammer 52 also pushes the dart 20 forwards into the flywheels 46. When the hammer 52 pushes the dart 20 forwards, the top portion 53 of the hammer 52 also moves under a subsequent dart 21 positioned above the dart 20, preventing the subsequent dart 21 from entering the entrance opening 16 and being launched by the projectile launcher 10. However, when the trigger means 30 is released the hammer 52 resets and the subsequent dart 21 moves into position, such that if the flywheels 46 have been sufficiently energized, a user may fire the subsequent dart 21 or multiple darts without having to re-pump or re-energize the flywheels 46.

From a top view (FIG. 3*b*) it is shown that the dart 20 has moved such that the tip 58 of the dart 20 has engaged the rotating flywheels 46. The flywheels 46 further include a contour 47 that is configured to match the shape of the tip 58, shown in FIG. 3*c*. The dart 20 also includes a body 59 that is smaller than the tip 58 such that the body 59 of the dart 20 passes through the flywheels 46 substantially friction free. The contour 47 of the flywheels 46 is such that the flywheels 46 will sufficiently grip only the tip 58 of the dart 20, therefore launching the dart 20 through the launch channel 14.

Figure 4A:
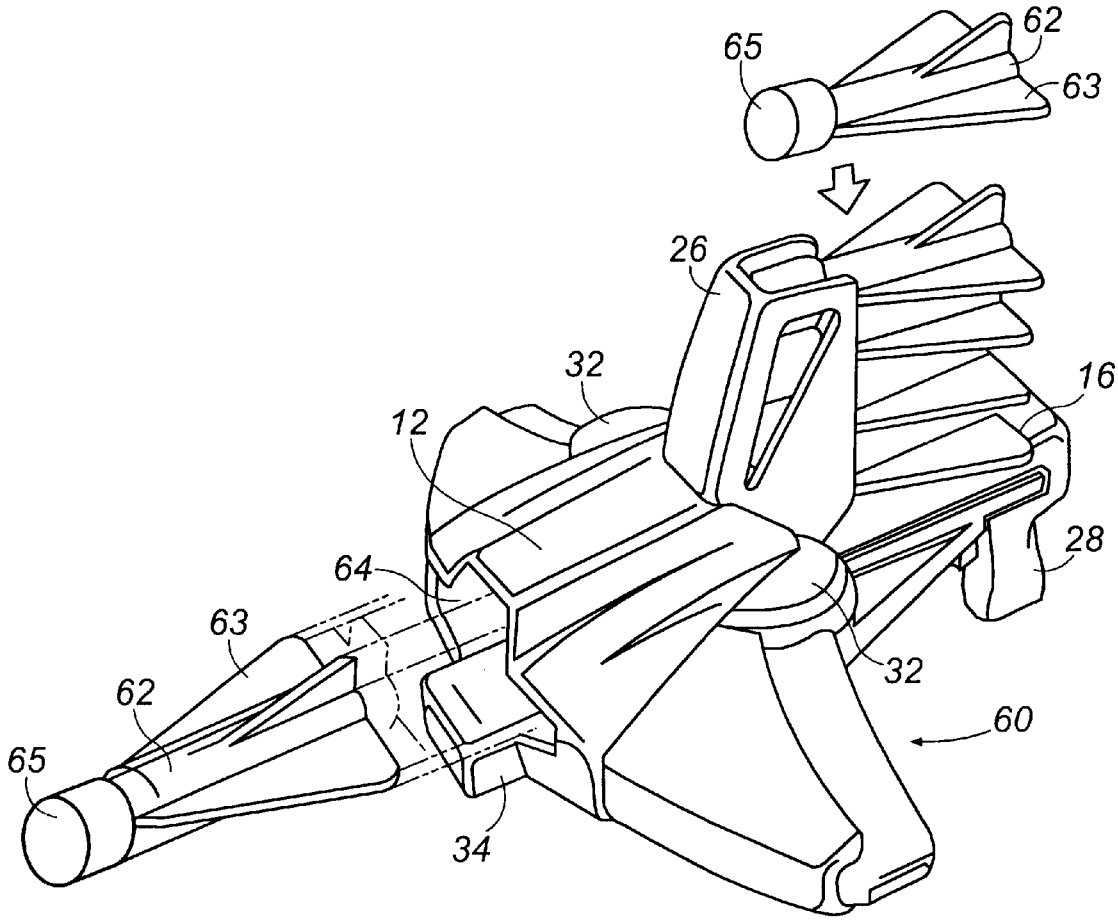
FIG. 4*a* is a perspective view of another embodiment of the present invention showing a projectile launcher that launches gliders.
Figure 4B:
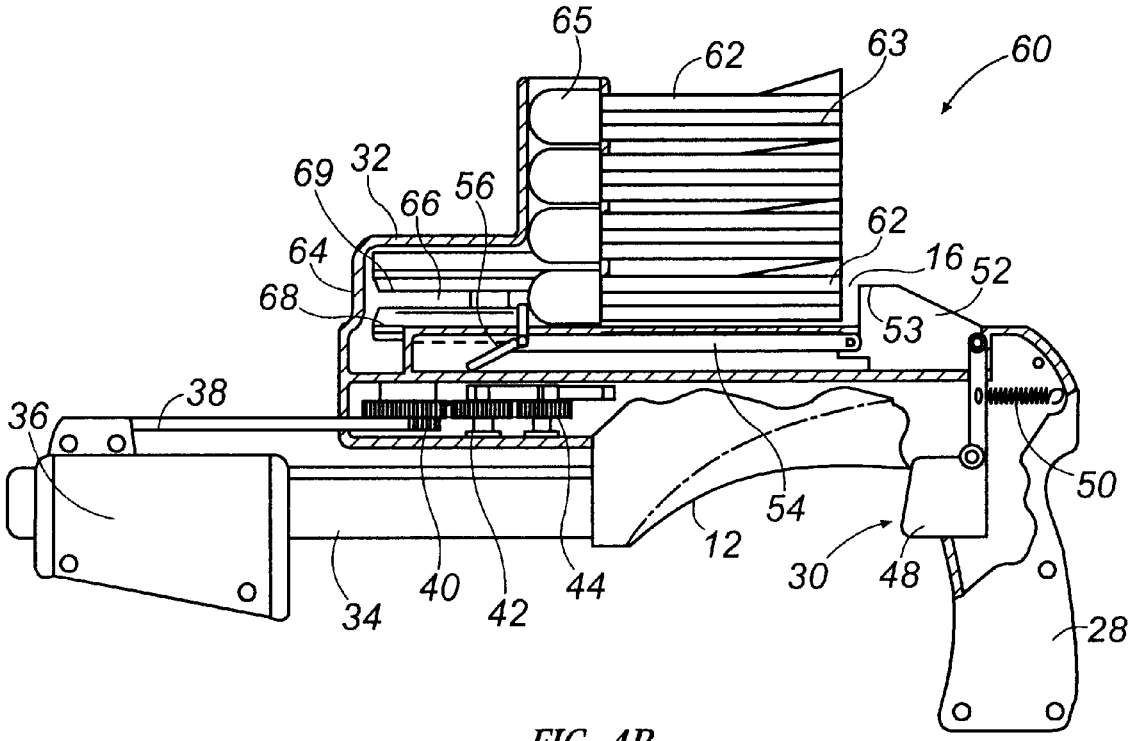
FIG. 4*b* is a partial cross-sectional view of the projectile launcher from FIG. 4*a* equipped with grooves in the flywheels to permit the substantially frictionless passage of gliders.

Referring now to FIGS. 4*a* and 4*b*, in another embodiment of the present invention, a projectile launcher 60 may be similarly configured but equipped to receive gliders 62.

Figure 5A:
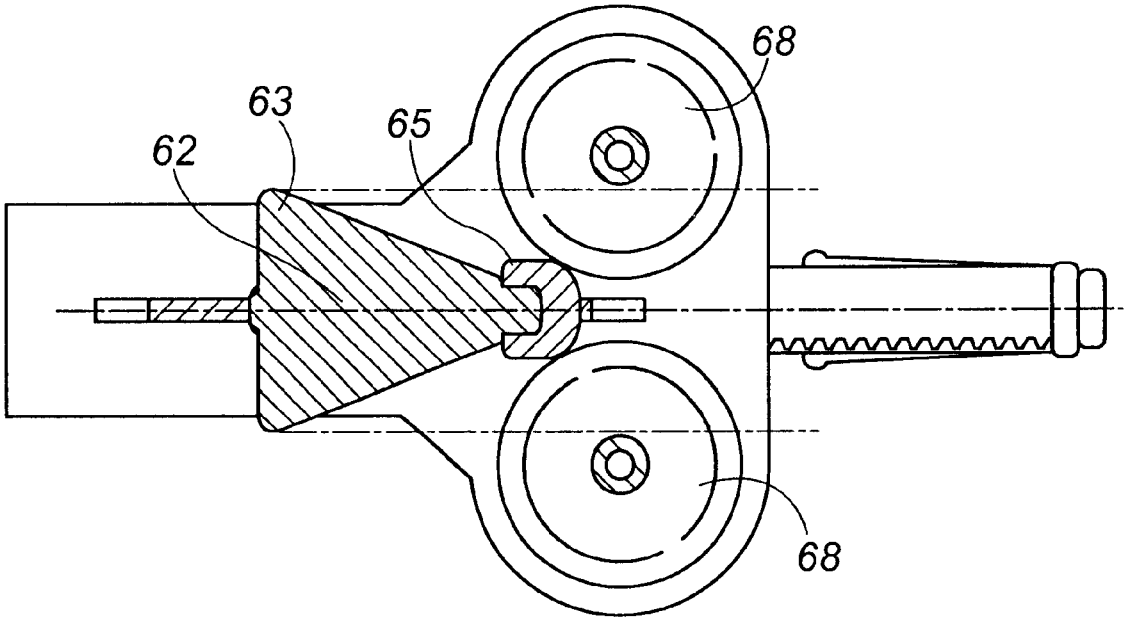
FIG. 5*a* is a cross-sectional top view of the projectile launcher from FIG. 4, showing the glider prior to being engaged by the flywheels.
Figure 5B:
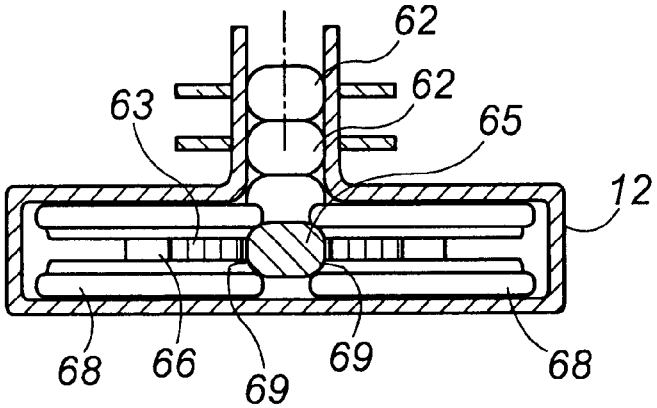
FIG. 5*b* is a front view of the projectile launcher from FIG. 4 showing the grooves and contour of the flywheels that are configured to match the profile of the tip of the glider and permit the wings to travel therethrough substantially friction free.

A launch channel 64 would include a wider opening so the wings 63 and tail of the glider 62 will not be obstructed. It is further noted that the flywheels 68 are rotated and energized in the manner stated above. Turning to FIGS. 4*b* and 5*a* and 5*b*, it is shown that the flywheels 68 include grooves 66 that permit the passage of the wings 63 through the flywheels 68 substantially friction free. In addition, the contour 69 of the flywheels 68 is configured such that the flywheels 68 engage the tip 65 of the gliders 62.

Figure 6:
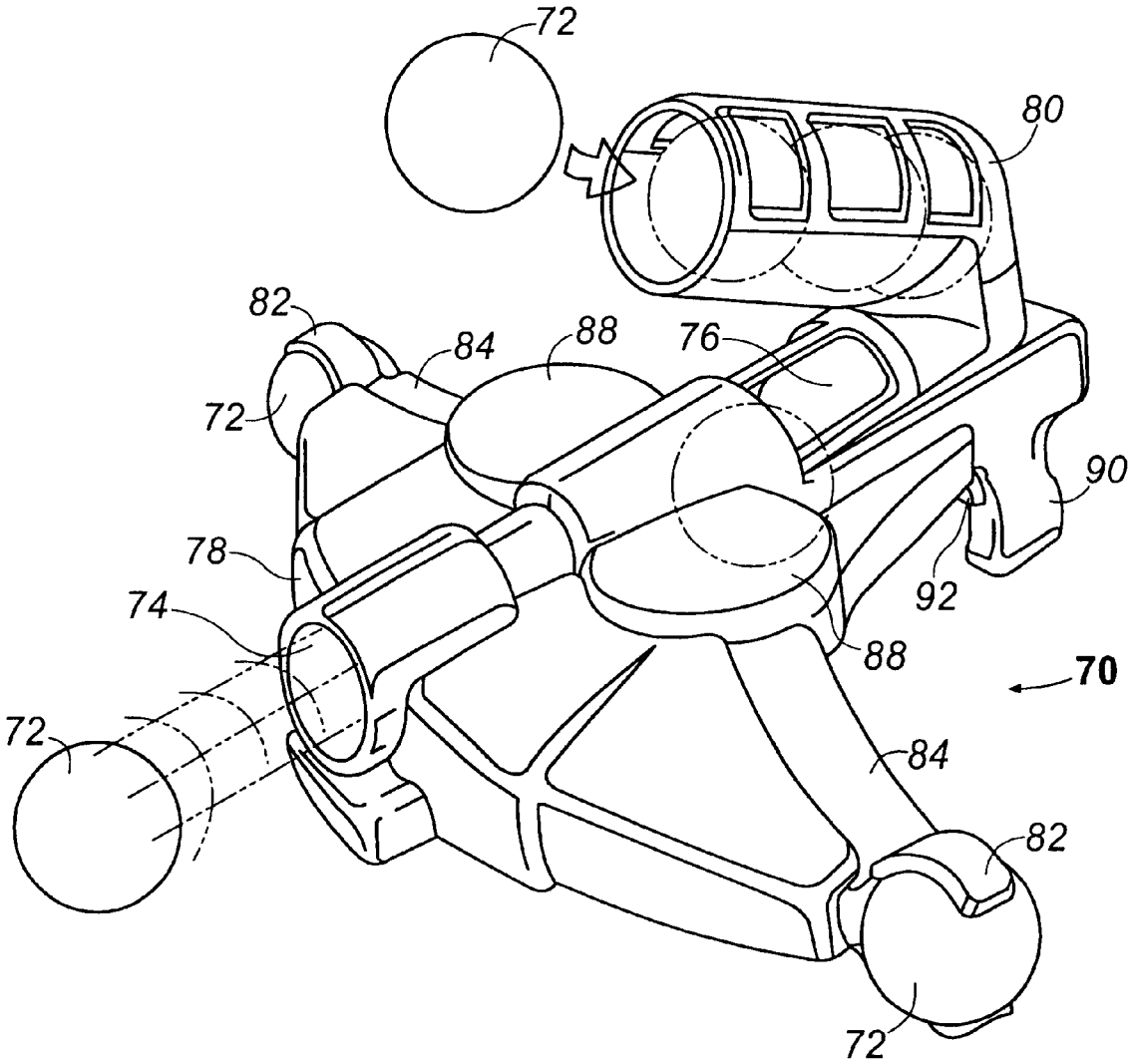
FIG. 6 is a perspective view of another embodiment of the present invention showing a projectile launcher that launches spheres.

Referring now to FIG. 6, in yet another embodiment of the present invention, a projectile launcher 70 is equipped to launch spheres 72. The projectile launcher 70 includes a launch channel 74 that includes an entrance and an exit opening 76 and 78, respectively. Multiple spheres 72 may be loaded through a chute 80 that is in communication with the entrance opening 76 and additional spheres 72 may be stored in clips 82 located on the projectile launcher 70. A pair of flywheels 86 is supported in apertures 88, which are located on either side of and are in communication with the launch channel 74. A handle 90 is also provided with a triggering means 92, which when pressed moves a sphere 72 or allows it to move from the entrance opening 76 to the launch channel 74, such that when the flywheels 86 are rotating (in a manner similar to the aforementioned embodiments) the sphere 72 may be projected out of the exit opening 76. In addition, when the triggering means 92 is pressed a second or subsequent sphere is prevented from entering the entrance opening 76 until the triggering means 92 is released and pressed again. It should also be noted, that the contour of the flywheels 86 are configured to the shape of the spheres 72 such that when the sphere 72 is dropped or moved into position the flywheels 86 engage and impel the spheres 72.

Figure 7A:
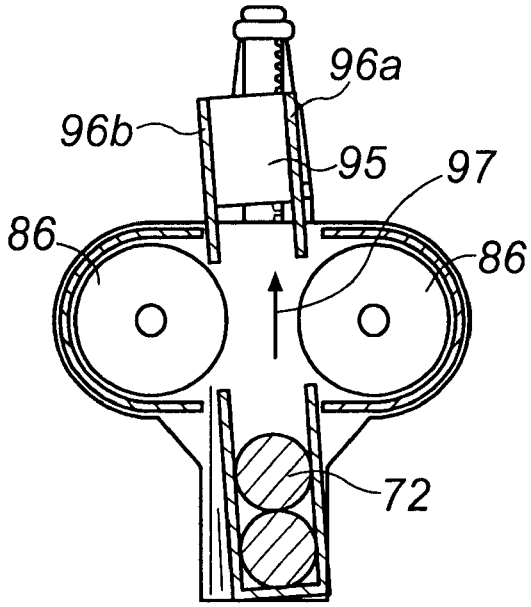
FIG. 7*a* is a top view of the projectile launcher from FIG. 6 with a pivotal launch channel that is pivoted to the left, which permits a sphere exiting therethrough to have a right curved trajectory.
Figure 7B:
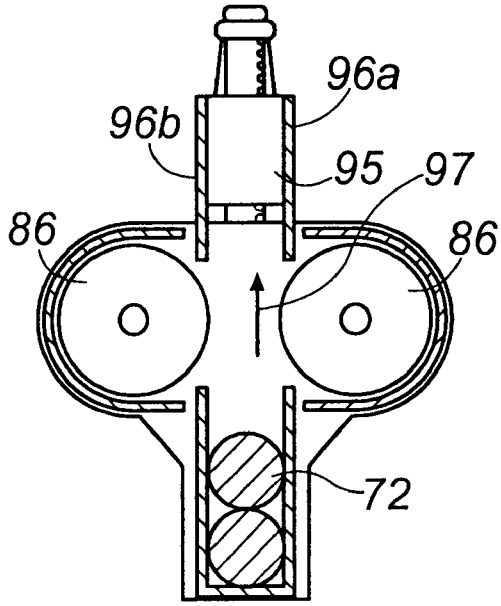
FIG. 7*b* is a top view of the projectile launcher from FIG. 6 showing the pivotal launch channel positioned in the center, which permits a sphere exiting therethrough to have a straight trajectory.
Figure 7C:
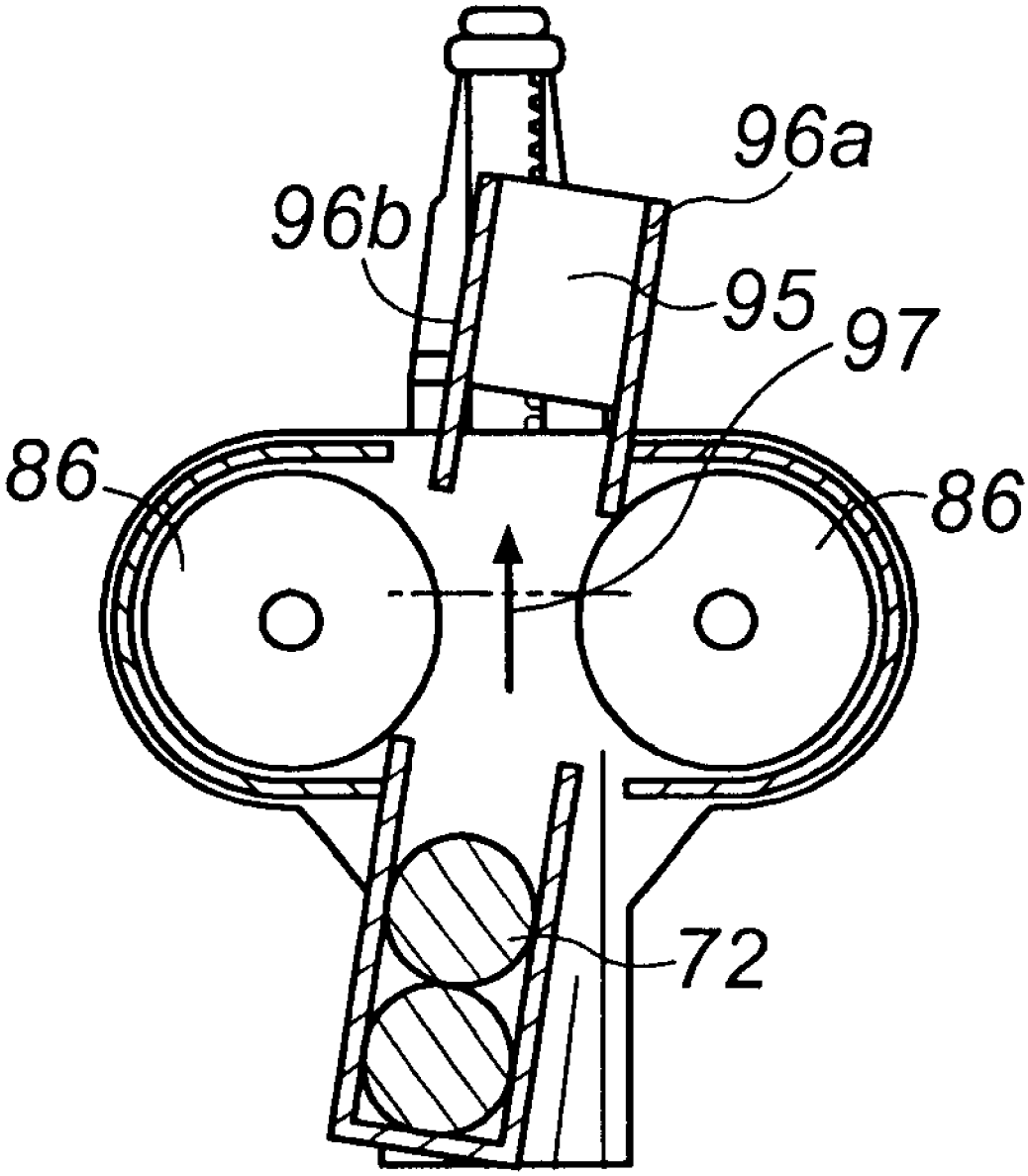
FIG. 7*c* is a top view of the projectile launcher from FIG. 6 showing the pivotal launch channel positioned to the right, which permits a sphere exiting therethrough to have a left curved trajectory.

Referring now to FIGS. 7*a* to 7*c*, the projectile launcher 70 includes a launch channel 95 that may be pivotably connected to the projectile launcher 70. As shown in FIGS. 7*a* to 7*c*, the pivotable launch channel 95 may pivot either to the left (FIG. 7*a*) or to the right (FIG. 7*c*). The flywheels 86 spinning at the same rate will always launch a sphere in a straight direction, indicated by arrow 97. But if the pivotable launch channel 95 is pivoted to the left, the sphere 72 will come into contact with the right wall 96*a* of the launch channel 95, which will impart a right spin on the sphere, such that when the sphere 72 exits, the trajectory of the sphere 72 will curve to the right. Consistent thereto, if the pivotable launch channel 95 is pivoted to the right, the sphere 72 will come into contact with the left wall 96*b* of the launch channel 95, which will impart a left spin on the sphere, such that when the sphere 72 exists, the trajectory of the sphere 72 will curve to the left. Also, when the launch channel 95 is pivoted to the center, the trajectory of the sphere 72 exiting the launch channel 95 will be straight, as the sphere should exist substantially unobstructed.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A projectile launcher comprising:

a housing supporting a hand grip and a launch channel, the launch channel having an entrance opening and an exit opening;

at least one projectile positioned in the entrance opening, each projectile has a predetermined shape defined by a tip and a body;

a preventing means for preventing said projectile positioned in the entrance opening from entering the launch channel;

a pair of flywheels in communication with and separately positioned on either side of the launch channel, each flywheel includes a predetermined contour that permits the pair of flywheels to engage the tip of the projectile and further allows the body of the projectile to move past the flywheels substantially unengaged;

a pump handle slidably connected to the housing, the pump handle is operably connected to the pair of flywheels such that when the pump handle is moved inwardly, the flywheels rotate to store energy; and a triggering means for releasing the preventing means, such that when the triggering means releases the preventing means, a projectile moves from the entrance opening to the launch channel and when the flywheels are rotating, the projectile is impelled out of the launch channel through the exit opening.

2. The projectile launcher of claim 1, further comprising a chute mounted to the launcher and in communication with the entrance opening.

3. The projectile launcher of claim 2, wherein the preventing means includes:

a retaining arm positioned in the launch channel such that the retaining arm may prevent a projectile from entering the launch channel; and a guide slot defined in the launch channel for guiding the retaining arm away from a projectile positioned in the entrance opening, when the retaining arm is released by said triggering means.

4. The projectile launcher of claim 3 wherein the triggering means includes:

a trigger pivotally attached to the housing;

a returning spring biasing the trigger outwardly; and a hammer secured to the trigger such that when the trigger is pressed inwardly, the hammer moves outwardly, the hammer is further attached to the retaining arm such that when the hammer moves outwardly, the retaining arm moves within the guide slot, the hammer also having a portion defined thereon which engages and moves a projectile positioned in the entrance opening to the launch channel.

5. The projectile launcher of claim 4 wherein the projectile has a body shaped as a glider.

6. The projectile launcher of claim 5 wherein the launch channel has a predetermined shape such that the glider may travel through the launch channel substantially unobstructed.

7. The projectile launcher of claim 6 wherein the flywheels further include grooves sized to accommodate the shape of the glider, such that the body of the glider may travel substantially friction free through the flywheels.

8. The projectile launcher of claim 1 further comprising:

a slider gear having an idle position and an engaged position, wherein when the slider gear is in the engaged position, the slider gear is operably connected to the flywheels, and wherein said pump handle further includes an integrated rack that meshes with said slider gear, such that when said pump handle is initially moved inwardly, the slider gear moves to the engaged position and when said pump handle is continually moved inwardly therefrom, the slider gear further rotates such that the flywheels may rotate and energize, and when said pump handle is moved outwardly, the slider gear moves to the idle position.

9. A projectile launcher comprising:

a housing having an entrance in communication with an exit channel to define a channel;

a hand-held grip supported by the housing;

a projectile positioned at the entrance;

a pair of flywheels supported by said housing and positioned on either side of the said channel, the pair of flywheels positioned to engage the projectile when said projectile enters the channel;

a pump handle slidably connected to the housing, the pump handle is operably connected to the pair of flywheels such that when the pump handle is moved, the pair of flywheels rotate to store energy, wherein when a projectile enters the channel, the projectile is engaged by the pair of energized rotating flywheels and impelled through the channel and out through the exit; and a portion of the exit channel is pivotally attached to the housing such that when the exit channel is pivoted, a projectile impelled by the pair of flywheels will come into contact with one side of the exit channel imparting a spin on the projectile such that the projectile will have a curved trajectory.

10. The projectile launcher of claim 9 wherein the means for rotating the flywheels includes:

a slider gear having an idle position and an engaged position, wherein when the slider gear is in the engaged position, the slider gear is operably connected to the pair of flywheels; and a pump handle slidably connected to the housing, the pump handle having an integrated rack that meshes with said slider gear, such that when said pump handle is initially moved inwardly, the slider gear moves to the engaged position and when said pump handle is continually moved inwardly therefrom, the slider gear further rotates such that the pair of flywheels rotate, and when said pump handle is moved outwardly, the slider gear moves to the idle position.

11. The projectile launcher of claim 10 further comprising a preventing means for preventing a projectile positioned in the entrance from entering the channel; and a triggering means set to release the preventing means when triggered by a user, such that when the triggering means releases the preventing means, a projectile positioned in the entrance may move to the channel.

12. The projectile launcher of claim 11 further comprising:

a chute mounted to the housing in communication with the entrance for stacking multiple projectiles such that when a preceding projectile is launched, the subsequent projectile may move to the entrance, when the triggering means resets.

13. The projectile launcher of claim 12, wherein each projectile has a predetermined shape defined by a tip and a body, and wherein the flywheels have a predetermined contour that is substantially the same as the predetermined shape of the tip such that the flywheels only engage the tip of the projectile and the body may move through the flywheels substantially friction free.

14. A projectile launcher comprising:

a housing having a launch channel, the launch channel having an entrance opening and an exit opening, the entrance opening sized to receive a projectile, the projectile includes a predetermined shape defined by a tip and a body;

a pair of flywheels separately and rotatably connected on either side of the launch channel;

a means for rotating the pair of flywheels; and each flywheel having a contour that permits the pair of flywheels to engage the tip of the projectile while allowing the body of the projectile to pass between the flywheels substantially friction free.

15. The projectile launcher of claim 14 wherein the means for rotating each flywheel includes:

a pump handle slidably connected to the housing;

a slider gear having an idle position and an engaged position, wherein when the slider gear is in the engaged position, the slider gear is operably connected to each flywheel; and a rack connected to the pump handle, the rack is further meshed with said slider gear such that when said pump handle is initially slid inwardly, the slider gear moves to the engaged position and when said pump handle is continually slid inwardly therefrom, the slider gear further rotates such that the flywheels rotate, and when said pump handle is moved outwardly, the slider gear moves to the idle position.

16. The projectile launcher of claim 15 further comprising a chute mounted to the housing in communication with the entrance opening for stacking multiple projectiles such that when a preceding projectile is launched, the subsequent projectile may move to the entrance opening.

17. The projectile launcher of claim 14 further comprising:

a preventing means for preventing a projectile positioned in the entrance opening from entering the launch channel; and a hand grip supported by the housing and having a triggering means for releasing the preventing means, such that when the triggering means releases the preventing means, a projectile positioned in the entrance opening moves to the launch channel and when the pair of flywheels are rotating, the tip of the projectile is engaged by the pair of flywheels and the projectile is impelled out of the launch channel through the exit opening.

* * * * *